US012083383B2

(12) United States Patent
Yarbor

(10) Patent No.: US 12,083,383 B2
(45) Date of Patent: Sep. 10, 2024

(54) SQUAT ASSISTANCE ASSEMBLY

(71) Applicant: Karl Yarbor, Belzoni, MS (US)

(72) Inventor: Karl Yarbor, Belzoni, MS (US)

( * ) Notice: Subject to any disclaimer, the term of this patent is extended or adjusted under 35 U.S.C. 154(b) by 123 days.

(21) Appl. No.: 18/087,937

(22) Filed: Dec. 23, 2022

(65) Prior Publication Data

US 2024/0207676 A1 Jun. 27, 2024

(51) Int. Cl.
*A63B 23/04* (2006.01)
*A63B 21/00* (2006.01)
*A63B 22/20* (2006.01)

(52) U.S. Cl.
CPC ..... *A63B 23/0405* (2013.01); *A63B 21/4007* (2015.10); *A63B 21/4035* (2015.10); *A63B 22/20* (2013.01); *A63B 2023/0411* (2013.01)

(58) Field of Classification Search
CPC .... A63B 22/20–208; A63B 2023/0411; A63B 2208/0223; A63B 23/04–0405
See application file for complete search history.

(56) References Cited

U.S. PATENT DOCUMENTS 4,700,945 A * 10/1987 Rader ..... A63B 21/055 482/96
5,336,152 A * 8/1994 Winslow ..... A63B 22/20 482/96
5,669,864 A * 9/1997 Brister ..... A63B 21/4029 482/142
6,761,672 B1 * 7/2004 Williams ..... A63B 21/0626 482/127
6,845,523 B2 * 1/2005 Copp ..... A41D 13/0007 2/463
7,087,004 B1 * 8/2006 Berke ..... A61H 7/002 601/134
7,874,971 B2 * 1/2011 Reyes ..... A63B 21/4005 482/133
D742,462 S * 11/2015 Cotto-Colon ..... D21/662
2003/0054926 A1 * 3/2003 Toole ..... A63B 21/0626 482/123
2004/0097353 A1 * 5/2004 Mencis ..... A63B 21/4045 482/148
2006/0160676 A1 * 7/2006 Sato ..... A63B 21/068 482/93

(Continued)

FOREIGN PATENT DOCUMENTS

DE 102016104576 A1 * 1/2017
GB 2418154 9/2004

(Continued)

*Primary Examiner* — Nyca T Nguyen

(57) ABSTRACT

A squat assistance assembly includes a panel that is wearable on a user's back thereby facilitating the panel to abut a wall against which the user is leaning. A pair of handles is each coupled to and curves forwardly thereby facilitating the user to grip the handles. A pair of shoulder straps is each coupled to the pad thereby facilitating each of the shoulder straps to be worn over a respective one of the user's shoulders. A pair of rollers is each rotatably attached to the panel. A belt extends around the pair of rollers thereby facilitating the belt to abut the wall against which the user is leaning. The belt rolling around each of the rollers as the user performs a squat exercise thereby facilitating the user to be stabilized against the wall while the user performs the squat exercise.

10 Claims, 5 Drawing Sheets

(56) References Cited

U.S. PATENT DOCUMENTS

| | | | | |
|---|---|---|---|---|
| 2011/0237987 | A1* | 9/2011 | Du | A63B 23/0417<br>601/24 |
| 2016/0279466 | A1* | 9/2016 | Smith | A63B 23/0405 |
| 2017/0050076 | A1* | 2/2017 | Beals | A63B 21/4039 |
| 2017/0291058 | A1* | 10/2017 | Marji | A63B 23/03516 |

FOREIGN PATENT DOCUMENTS

| | | | | |
|---|---|---|---|---|
| KR | 102610302 | B1 * | 11/2022 | |
| TW | 201936235 | | 9/2019 | |
| WO | WO-2021072249 | A1 * | 4/2021 | A63B 21/00196 |

* cited by examiner

SQUAT ASSISTANCE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to squat devices and more particularly pertains to a new squat device for assisting a physically limited user with performing a squat exercise. The device includes a panel and shoulder straps attached to the panel for wearing the panel on a user's back. The device includes a pair of rollers each rotatably attached to the panel and a belt extending around the rollers. The user leans against a wall while wearing the panel on their back such that the belt rolls upwardly and downwardly along the wall while the user performs a squat exercise.

(2) Description of Related Art Including Information Disclosed Under 37 CFR 1.97 and 1.98

The prior art relates to squat devices including an exercise device that includes a plate that is worn on a user's back and either wheels, rollers or a low friction material disposed on the plate for moving upwardly and downwardly along a wall while a user performs a squat exercise. The prior art discloses an exercise device that includes a wheeled cart, an adjunct unit that includes a rigid rod and a flexible member. The prior art discloses an exercise machine that includes a plate that is shaped to conform to a user's back and a pair of rollers each rotatably disposed on the plate for rolling upwardly and downwardly along a wall while a user performs a squat exercise. The prior art discloses an exercise device that includes a plate that is wearable on a user's back, a triangular frame pivotally attached to the plate and a plurality of wheels each rotatably attached to the triangular frame for rolling along a wall while the user performs a squat exercise.

BRIEF SUMMARY OF THE INVENTION

An embodiment of the disclosure meets the needs presented above by generally comprising a panel that is wearable on a user's back thereby facilitating the panel to abut a wall against which the user is leaning. A pair of handles is each coupled to and curves forwardly thereby facilitating the user to grip the handles. A pair of shoulder straps is each coupled to the pad thereby facilitating each of the shoulder straps to be worn over a respective one of the user's shoulders. A pair of rollers is each rotatably attached to the panel. A belt extends around the pair of rollers thereby facilitating the belt to abut the wall against which the user is leaning. The belt rolling around each of the rollers as the user performs a squat exercise thereby facilitating the user to be stabilized against the wall while the user performs the squat exercise.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
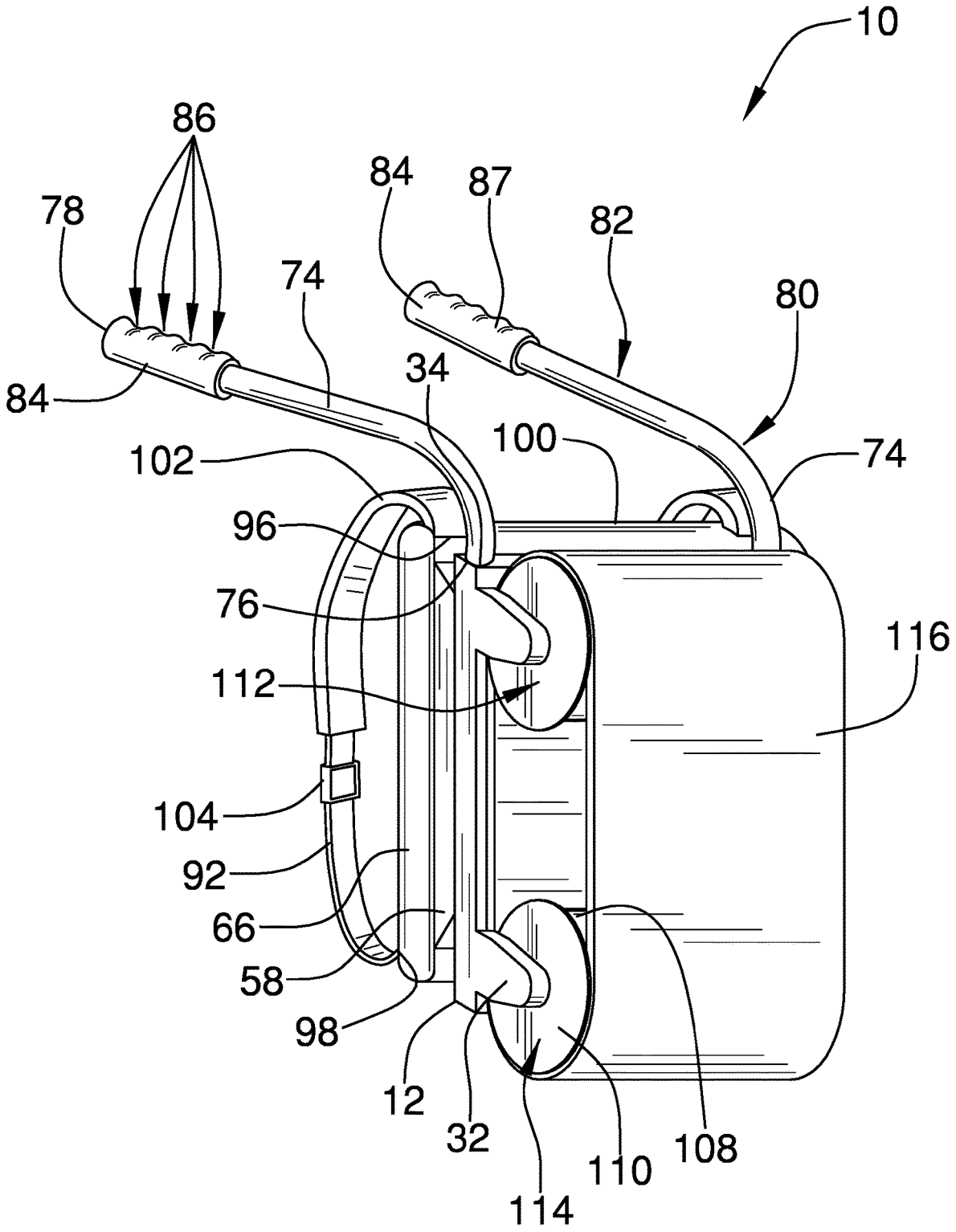
FIG. 1 is a back perspective view of a squat assistance assembly according to an embodiment of the disclosure.
Figure 2:
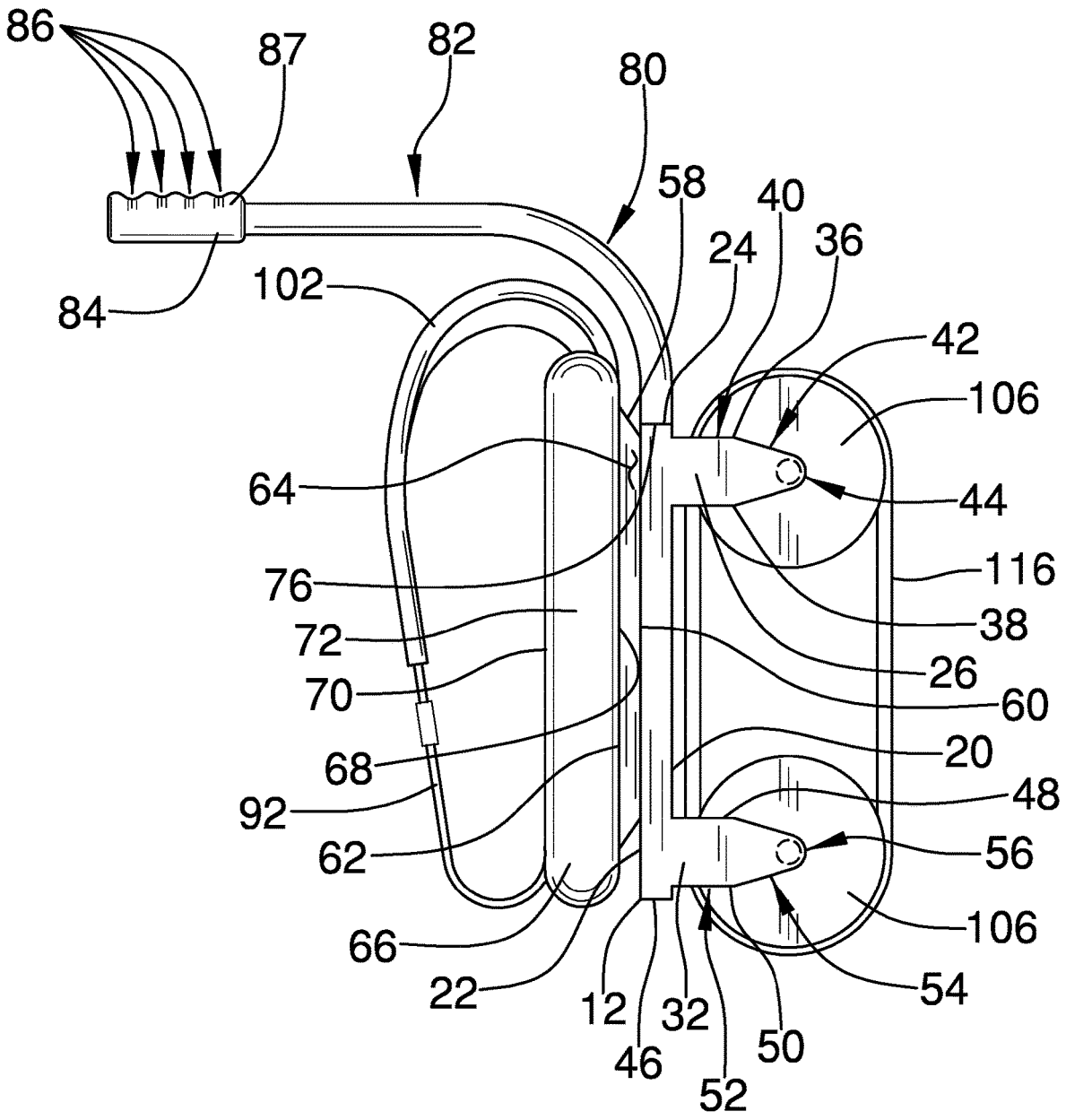
FIG. 2 is a left side view of an embodiment of the disclosure.
Figure 3:
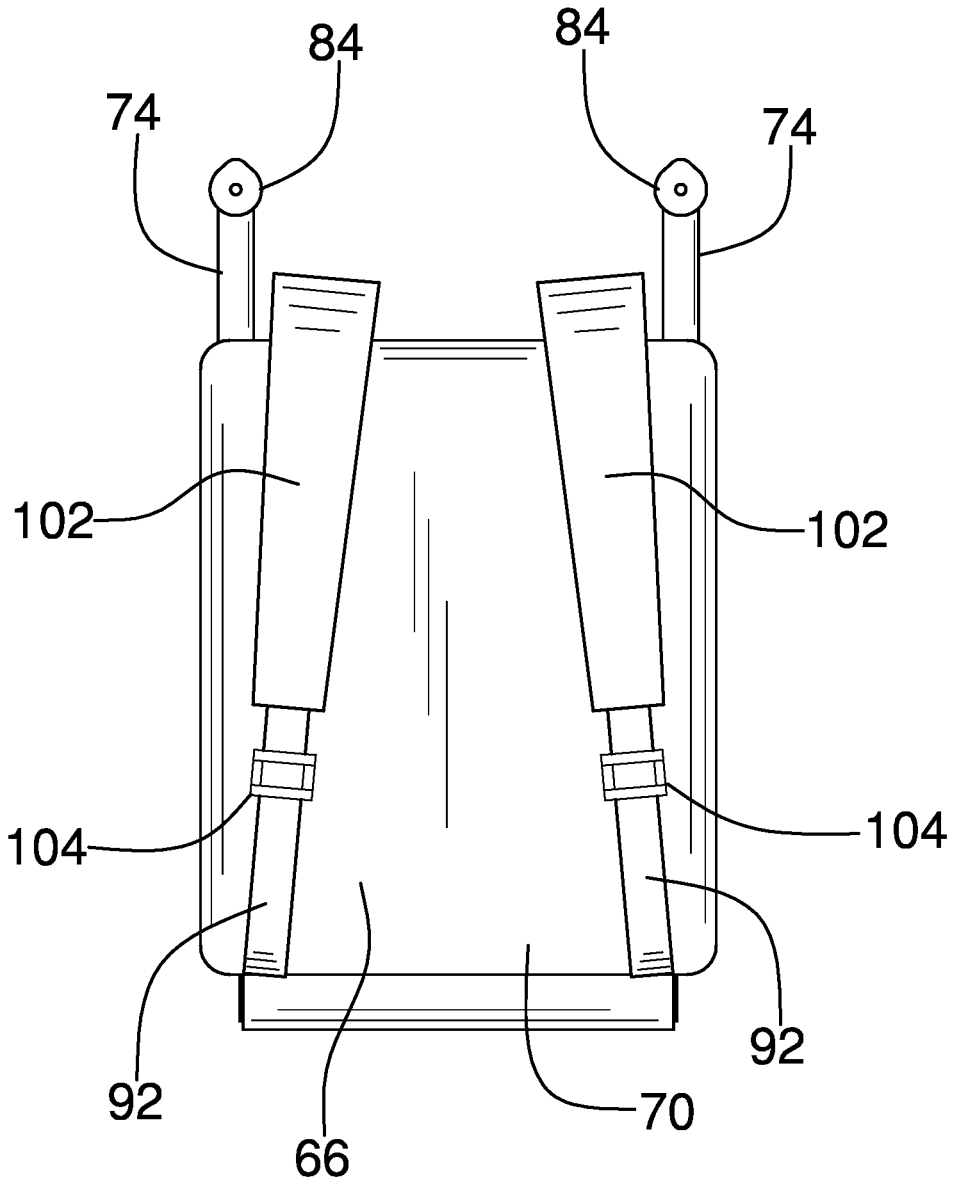
FIG. 3 is a front view of an embodiment of the disclosure.
Figure 4:
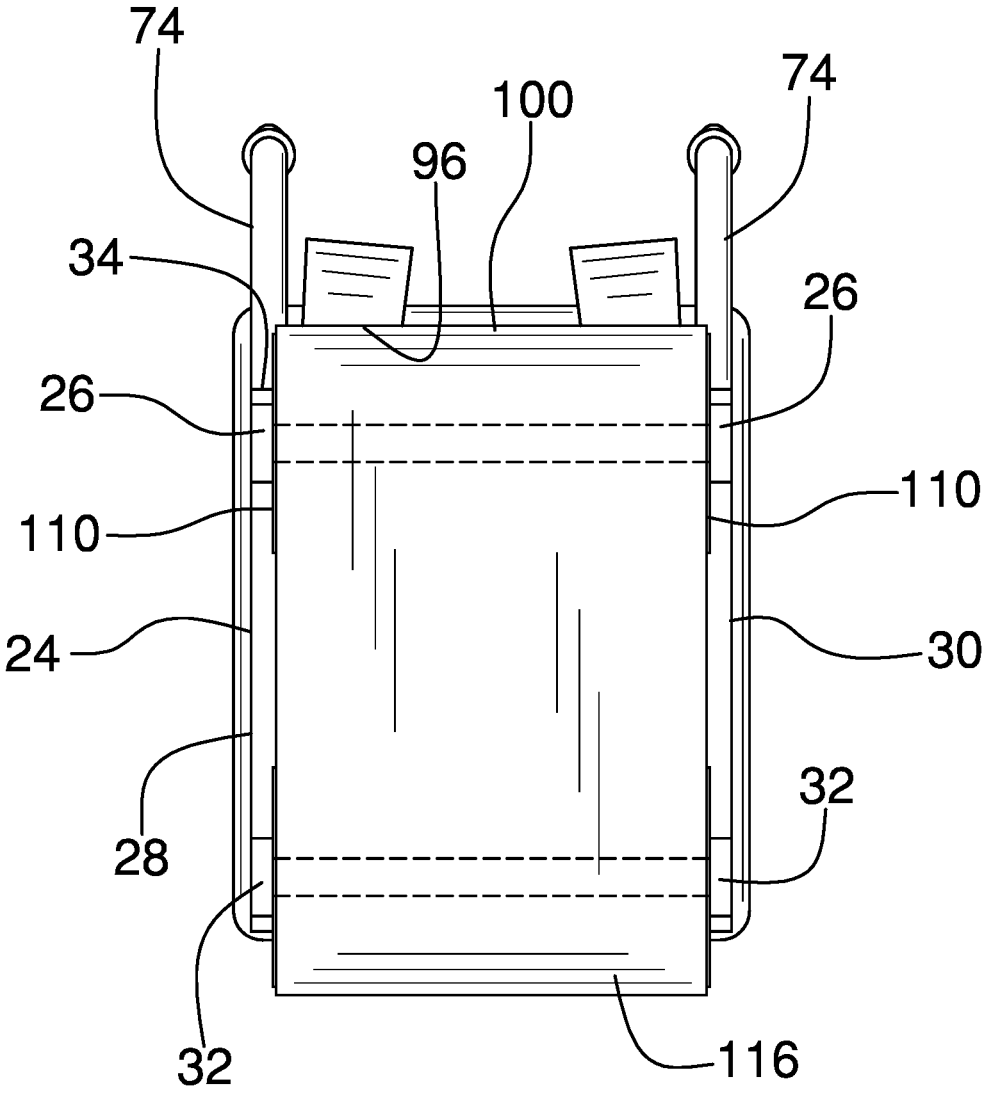
FIG. 4 is a back view of an embodiment of the disclosure.
Figure 5:
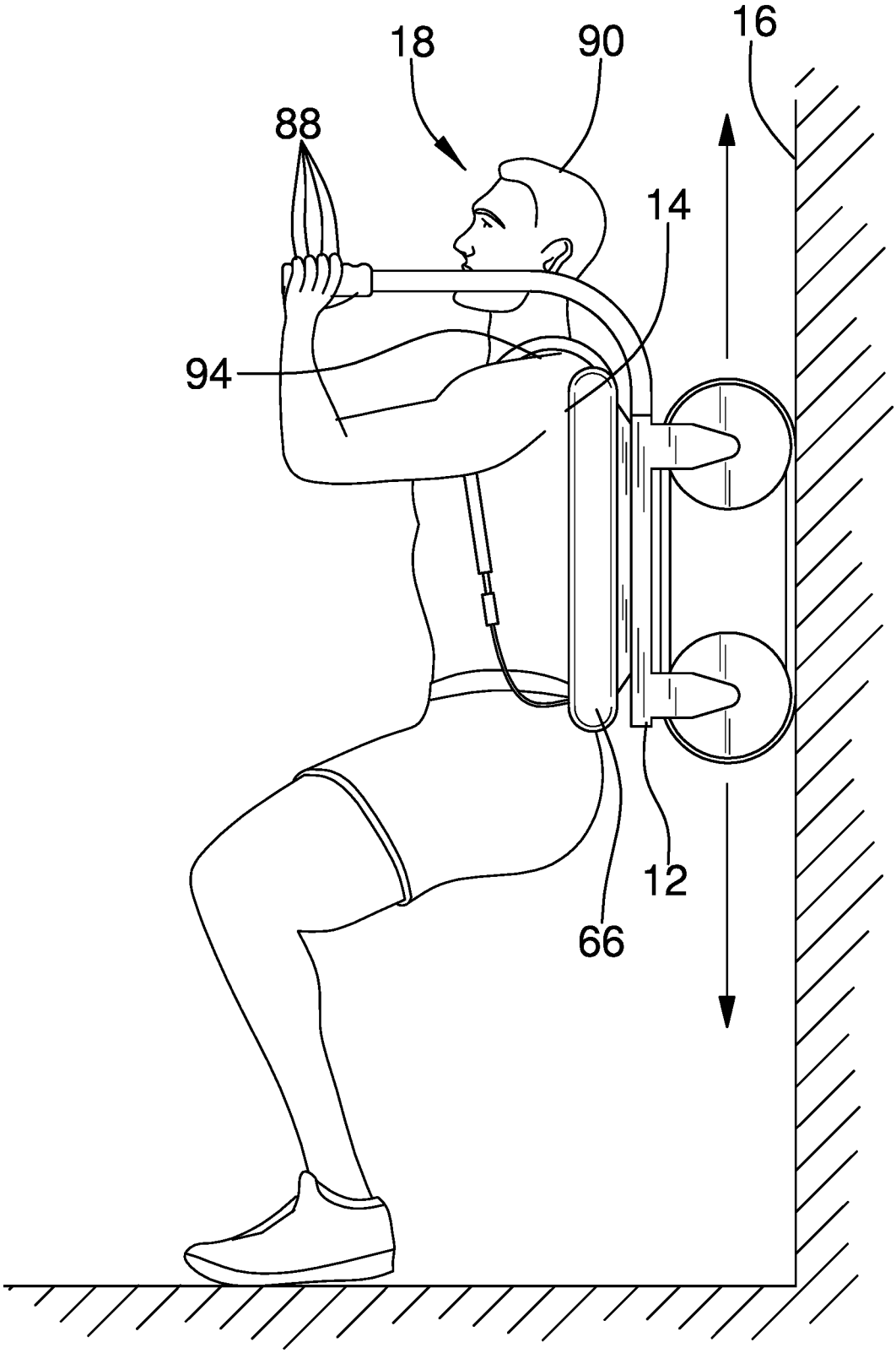
FIG. 5 is a perspective in-use view of an embodiment of the disclosure.

With reference now to the drawings, and in particular to FIGS. 1 through 5 thereof, a new squat device embodying the principles and concepts of an embodiment of the disclosure and generally designated by the reference numeral 10 will be described.

As best illustrated in FIGS. 1 through 5, the squat assistance assembly 10 generally comprises a panel 12 that is wearable on a user's back 14 thereby facilitating the panel 12 to abut a wall 16 against which the user 18 is leaning. The wall 16 may be a wall 16 of a room in a house or other similar type of vertical support surface. The user 18 may be a physically limited user, such as an elderly person or a person recovering from a surgical procedure or any other person that is incapable of performing a squat exercise without assistance. The panel 12 has a rear surface 20, a front surface 22 and a perimeter edge 24 extending between the front surface 22 and the rear surface 20. The panel 12 has a pair of first lobes 26 each extending away from the rear surface 20 and each of the first lobes 26 is aligned with a respective one of a first lateral side 28 and a second lateral side 30 of the perimeter edge 24 of the panel 12. The panel 12 has a pair of second lobes 32 each extending away from the rear surface 20 and each of the second lobes 32 is aligned with a respective one of the first lateral side 28 and the second lateral side 30 of the panel 12.

Each of the first lobes 26 is positioned proximate a top side 34 of the perimeter edge 24 of the panel 12 and each of the first lobes 26 has a top side 36 and a bottom side 38. Furthermore, each of the top side 36 and the bottom side 38 of each of the first lobes 26 has a first section 40 that is perpendicularly oriented with the rear surface 20 and the panel 12 and a second section 42 angling inwardly between the first section 40 and a distal end 44 of a respective first lobe 26. The distal end 44 of each of the first lobes 26 is rounded. Each of the second lobes 32 is positioned proximate a bottom side 46 of the perimeter edge 24 of the panel 12 and each of the second lobes 32 has a top side 48 and a bottom side 50. Each of the top side 48 and the bottom side 50 of each of the second lobes 32 has a primary section 52 that is perpendicularly oriented with the rear surface 20 and the panel 12 and a secondary section 54 angling inwardly between the primary section 52 and a distal end 56 of a respective second lobe 32. The distal end 56 of each of the second lobes 32 is rounded.

A pad support 58 is provided and the pad support 58 is attached to the panel 12. The pad support 58 has a back surface 60, a forward surface 62 and an exterior surface 64 extending between the forward surface 62 and the back surface 60. The exterior surface 64 angles outwardly between the back surface 60 and the forward surface 62 such that the forward surface 62 has a length and a width that is greater than a length and a width of the back surface 60. The back surface 60 is attached to the front surface 22 of the panel 12 and the pad support 58 is positioned closer to the top side 34 of the perimeter edge 24 of the panel 12 than the bottom side 46 of the perimeter edge 24 of the panel 12. Furthermore, the pad support 58 is positioned closer to the top side 34 of the perimeter edge 24 of the panel 12 than the bottom side 46 of the perimeter edge 24 of the panel 12.

A pad 66 is attached to the pad support 58 thereby facilitating the pad 66 to rest against the user's back 14 for enhancing comfort for the user 18. The pad 66 has a rear side 68, a front side 70 and an outer side 72 extending between the rear side 68 and the front side 70. The rear side 68 is bonded to the forward surface 62 of the pad support 58 and the outer side 72 curves outwardly between the rear side 68 and the front side 70. The rear side 68 has a length and a width that is greater than the length and the width of the forward surface 62 of the pad support 58 such that the pad 66 extends upwardly beyond the top side 34 of the perimeter edge 24 of the panel 12.

A pair of handles 74 is provided and each of the handles 74 is coupled to and curving forwardly from the panel 12 such that each of the handles 74 is positioned above the user 18 when the user 18 rests against the pad 66 thereby facilitating the user 18 to grip the handles 74. Each of the handles 74 has a coupled end 76 and a free end 78 and the coupled end 76 of each of the handles 74 is coupled to the top side 34 of the perimeter edge 24 of the panel 12. Each of the handles 74 is positioned adjacent to a respective one of the first lateral side 28 and the second lateral side 30 of the perimeter edge 24 of the panel 12. Each of the handles 74 has a bend 80 that is positioned adjacent to the coupled end 76 to define a forward portion 82 of each of the handles 74 extending forwardly from the panel 12.

A pair of grips 84 is provided and each of the grips 84 extends from the coupled end 76 of a respective handle 74 toward the bend 80 of the respective handle 74. Each of the grips 84 has a plurality of depressions 86 which are spaced apart from each other and are distributed along a length of the grips 84. Furthermore, the plurality of depressions 86 on each of the grips 84 is positioned on a top side 87 of the respective grip 84 thereby facilitating the plurality of depressions 86 on each of the grips 84 to accommodate the user's fingers 88 when the user 18 reaches over the user's head 90 to grip the grips 84.

A pair of shoulder straps 92 is provided and each of the shoulder straps 92 is coupled to the pad 66 thereby facilitating each of the shoulder straps 92 to be worn over a respective one of the user's shoulders 94. Each of the shoulder straps 92 has a first end 96 that is coupled to the front side 70 of the pad 66 and each of the shoulder straps 92 has a second end 98 that is coupled to a top side 100 of the outer side 72 of the pad 66. Each of the shoulder straps 92 has a shoulder pad 102 extending from the second end 98 toward the first end 96 thereby facilitating the shoulder pad 102 on each of the shoulder straps 92 to cushion the user's shoulders 94. Additionally, each of the shoulder straps 92 includes an adjuster 104 for adjusting a length of the shoulder straps 92.

A pair of rollers 106 is provided and each of the rollers 106 is rotatably attached to the panel 12. Each of the rollers 106 comprises a cylinder 108 which extends between a pair of disks 110. Each of the disks 110 associated with each of the rollers 106 has a diameter that is greater than a diameter of the cylinder 108 associated with the rollers 106. The pair of rollers 106 includes a first roller 112 and a second roller 114. Each of the disks 110 associated with the first roller 112 is rotatably attached to a respective one of the first lobes 26 on the panel 12 such that the cylinder 108 associated with the first roller 112 is oriented to extend between the first lobes 26. Additionally, each of the disks 110 associated with the second roller 114 is rotatably attached to a respective one of the second lobes 32 on the panel 12 such that the cylinder 108 associated with the second roller 114 is oriented to extend between the second lobes 32.

A belt 116 extends around the pair of rollers 106 thereby facilitating the belt 116 to abut the wall 16 against which the user 18 is leaning. The belt 116 rolls around each of the rollers 106 as the user 18 performs a squat exercise thereby facilitating the user 18 to be stabilized against the wall 16 while the user 18 performs the squat exercise. In this way the panel 12, the rollers 106 and the belt 116 facilitate the user 18 with limited balance and stability to safely perform a squat exercise. The belt 116 extends around the cylinder 108 associated with each of the first roller 112 and the second roller 114. Additionally, the pair of disks 110 associated with each of the first roller 112 and the second roller 114 inhibits the belt 116 from travelling laterally off of the first roller 112 and the second roller 114.

In use, the user 18 wears each of the shoulder straps 92 over their shoulders such that the pad 66 rests against the user's back 14. The user 18 stands against the wall 16 such that the belt 116 abuts the wall 16 and the user 18 grips 84 each of the grips 84 on the handles 74. The user 18 then performs a squat exercise and the belt 116 travels around each of the rollers 106 as the user 18 squats and stands in the course of performing the squat exercise. In this way the user 18 is stabilized against the wall 16 thereby facilitating the user 18 to perform the squat exercise without assistance.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A squat assistance assembly for facilitating a user to perform squat exercises against a wall, said assembly comprising:

a panel being wearable on a user's back thereby facilitating said panel to abut a wall against which the user is leaning;

a pad support being attached to said panel;

a pad being attached to said pad support thereby facilitating said pad to rest against the user's back wherein said pad is configured to enhance comfort for the user;

a pair of handles, each of said handles being coupled to and curving forwardly from said panel such that each of said handles is positioned above the user when the user rests against said pad thereby facilitating the user to grip said handles;

a pair of shoulder straps, each of said shoulder straps being coupled to said pad thereby facilitating each of said shoulder straps to be worn over a respective one of the user's shoulders;

a pair of rollers, each of said rollers being rotatably attached to said panel; and a belt extending around said pair of rollers thereby facilitating said belt to abut the wall against which the user is leaning, said belt rolling around each of said rollers as the user performs a squat exercise thereby facilitating the user to be stabilized against the wall while the user performs the squat exercise wherein said panel and said rollers and said belt are configured to facilitate a user with limited balance and stability to safely perform a squat exercise.

2. The assembly according to claim 1, wherein:

said panel has a rear surface, a front surface and a perimeter edge extending between said front surface and said rear surface;

said panel has a pair of first lobes each extending away from said rear surface, each of said first lobes being aligned with a respective one of a first lateral side and a second lateral side of said perimeter edge of said panel, each of said first lobes being positioned proximate a top side of said perimeter edge of said panel, each of said first lobes having a top side and a bottom side, each of said top side and said bottom side of each of said first lobes having a first section being perpendicularly oriented with said rear surface and said panel and a second section angling inwardly between said first section and a distal end of a respective first lobe, said distal end of each of said first lobes being rounded; and said panel has a pair of second lobes each extending away from said rear surface, each of said second lobes being aligned with a respective one of said first lateral side and said second lateral side of said perimeter edge of said panel, each of said second lobes being positioned proximate a bottom side of said perimeter edge of said panel, each of said second lobes having a top side and a bottom side, each of said top side and said bottom side of each of said second lobes having a primary section being perpendicularly oriented with said rear surface and said panel and a secondary section angling inwardly between said primary section and a distal end of a respective second lobe, said distal end of each of said second lobes being rounded.

3. The assembly according to claim 2, wherein said pad support has a back surface, a forward surface and an exterior surface extending between said forward surface and said back surface, said exterior surface angling outwardly between said back surface and said forward surface such that said forward surface has a length and a width being greater than a length and a width of said back surface, said back surface being attached to said front surface of said panel, said pad support being positioned closer to said top side of said perimeter edge of said panel than said bottom side of said perimeter edge of said panel, said pad support being positioned closer to said top side of said perimeter edge of said panel than said bottom side of said perimeter edge of said panel.

4. The assembly according to claim 3, wherein said pad has a rear side, a front side and a outer side extending between said rear side and said front side, said rear side being bonded to said forward surface of said pad support, said outer side curving outwardly between said rear side and said front side, said rear side having a length and a width being greater than said length and said width of said forward surface of said pad support such that said pad extends upwardly beyond said top side of said perimeter edge of said panel.

5. The assembly according to claim 2, wherein each of said handles has a coupled end and a free end, said coupled end of each of said handles being coupled to said top side of said perimeter edge of said panel, each of said handles being positioned adjacent to a respective one of said first lateral side and said second lateral side of said perimeter edge of said panel, each of said handles having a bend being positioned adjacent to said coupled end to define a forward portion of each of said handles extending forwardly from said panel.

6. The assembly according to claim 5, further comprising a pair of grips, each of said grips extending from said coupled end of a respective handle toward said bend of said respective handle, each of said grips having a plurality of depressions being spaced apart from each other and being distributed along a length of said grips, said plurality of depressions on each of said grips being positioned on a top side of said respective grip thereby facilitating said plurality of depressions on each of said grips to accommodate the user's fingers when the user reaches over their head to grip said grips.

7. The assembly according to claim 4, wherein each of said shoulder straps has a first end being coupled to said front side of said pad, each of said shoulder straps having a second end being coupled to a top side of said outer side of said pad, each of said shoulder straps having a shoulder pad extending from said second end toward said first end thereby facilitating said shoulder pad on each of said shoulder straps to cushion the user's shoulders, each of said shoulder straps including an adjuster for adjusting a length of said shoulder straps.

8. The assembly according to claim 2, wherein each of said rollers comprises a cylinder extending between a pair of disks, each of said disks associated with each of said rollers having a diameter being greater than a diameter of said cylinder associated with said rollers, said pair of rollers including a first roller and a second roller, each of said disks associated with said first roller being rotatably attached to a respective one of said first lobes on said panel such that said cylinder associated with said first roller is oriented to extend between said first lobes, each of said disks associated with said second roller being rotatably attached to a respective one of said second lobes on said panel such that said cylinder associated with said second roller is oriented to extend between said second lobes.

9. The assembly according to claim 8, wherein said belt extends around said cylinder associated with each of said first roller and said second roller, said pair of disks associated with each of said first roller and said second roller inhibiting said belt from travelling laterally off of said first roller and said second roller.

10. A squat assistance assembly for facilitating a user to perform squat exercises against a wall, said assembly comprising:

a panel being wearable on a user's back thereby facilitating said panel to abut a wall against which the user is leaning, said panel having a rear surface, a front surface and a perimeter edge extending between said front surface and said rear surface, said panel having a pair of first lobes each extending away from said rear surface, each of said first lobes being aligned with a respective one of a first lateral side and a second lateral side of said perimeter edge of said panel, each of said first lobes being positioned proximate a top side of said perimeter edge of said panel, each of said first lobes having a top side and a bottom side, each of said top side and said bottom side of each of said first lobes having a first section being perpendicularly oriented with said rear surface and said panel and a second section angling inwardly between said first section and a distal end of a respective first lobe, said distal end of each of said first lobes being rounded, said panel having a pair of second lobes each extending away from said rear surface, each of said second lobes being aligned with a respective one of said first lateral side and said second lateral side of said perimeter edge of said panel, each of said second lobes being positioned proximate a bottom side of said perimeter edge of said panel, each of said second lobes having a top side and a bottom side, each of said top side and said bottom side of each of said second lobes having a primary section being perpendicularly oriented with said rear surface and said panel and a secondary section angling inwardly between said primary section and a distal end of a respective second lobe, said distal end of each of said second lobes being rounded;

a pad support being attached to said panel, said pad support having a back surface, a forward surface and an exterior surface extending between said forward surface and said back surface, said exterior surface angling outwardly between said back surface and said forward surface such that said forward surface has a length and a width being greater than a length and a width of said back surface, said back surface being attached to said front surface of said panel, said pad support being positioned closer to said top side of said perimeter edge of said panel than said bottom side of said perimeter edge of said panel, said pad support being positioned closer to said top side of said perimeter edge of said panel than said bottom side of said perimeter edge of said panel;

a pad being attached to said pad support thereby facilitating said pad to rest against the user's back wherein said pad is configured to enhance comfort for the user, said pad having a rear side, a front side and a outer side extending between said rear side and said front side, said rear side being bonded to said forward surface of said pad support, said outer side curving outwardly between said rear side and said front side, said rear side having a length and a width being greater than said length and said width of said forward surface of said pad support such that said pad extends upwardly beyond said top side of said perimeter edge of said panel;

a pair of handles, each of said handles being coupled to and curving forwardly from said panel such that each of said handles is positioned above the user when the user rests against said pad thereby facilitating the user to grip said handles, each of said handles having a coupled end and a free end, said coupled end of each of said handles being coupled to said top side of said perimeter edge of said panel, each of said handles being positioned adjacent to a respective one of said first lateral side and said second lateral side of said perimeter edge of said panel, each of said handles having a bend being positioned adjacent to said coupled end to define a forward portion of each of said handles extending forwardly from said panel;

a pair of grips, each of said grips extending from said coupled end of a respective handle toward said bend of said respective handle, each of said grips having a plurality of depressions being spaced apart from each other and being distributed along a length of said grips, said plurality of depressions on each of said grips being positioned on a top side of said respective grip thereby facilitating said plurality of depressions on each of said grips to accommodate the user's fingers when the user reaches over their head to grip said grips;

a pair of shoulder straps, each of said shoulder straps being coupled to said pad thereby facilitating each of said shoulder straps to be worn over a respective one of the user's shoulders, each of said shoulder straps having a first end being coupled to said front side of said pad, each of said shoulder straps having a second end being coupled to a top side of said outer side of said pad, each of said shoulder straps having a shoulder pad extending from said second end toward said first end thereby facilitating said shoulder pad on each of said shoulder straps to cushion the user's shoulders, each of said shoulder straps including an adjuster for adjusting a length of said shoulder straps;

a pair of rollers, each of said rollers being rotatably attached to said panel, each of said rollers comprising a cylinder extending between a pair of disks, each of said disks associated with each of said rollers having a diameter being greater than a diameter of said cylinder associated with said rollers, said pair of rollers including a first roller and a second roller, each of said disks associated with said first roller being rotatably attached to a respective one of said first lobes on said panel such that said cylinder associated with said first roller is oriented to extend between said first lobes, each of said disks associated with said second roller being rotatably attached to a respective one of said second lobes on said panel such that said cylinder associated with said second roller is oriented to extend between said second lobes; and a belt extending around said pair of rollers thereby facilitating said belt to abut the wall against which the user is leaning, said belt rolling around each of said rollers as the user performs a squat exercise thereby facilitating the user to be stabilized against the wall while the user performs the squat exercise wherein said panel and said rollers and said belt are configured to facilitate a user with limited balance and stability to safely perform a squat exercise, said belt extending around said cylinder associated with each of said first roller and said second roller, said pair of disks associated with each of said first roller and said second roller inhibiting said belt from travelling laterally off of said first roller and said second roller.

* * * * *